US005255464A

United States Patent [19]

Marecek

[11] Patent Number: 5,255,464

[45] Date of Patent: Oct. 26, 1993

[54] TAILGATE SIGN

[76] Inventor: Robert L. Marecek, 12501 Prospect, NE., Albuquerque, N. Mex. 87112

[21] Appl. No.: 649,155

[22] Filed: Feb. 1, 1991

Related U.S. Application Data

[63] Continuation of Ser. No. 409,532, Sep. 27, 1989, abandoned.

[51] Int. Cl.[5] ..... G09F 21/04

[52] U.S. Cl. ..... 40/591; 40/588

[58] Field of Search ..... 160/327, 328, 329, 370.2, 160/DIG. 2, DIG. 3; 296/95.1; 206/335; 224/277; 150/166

[56] References Cited

U.S. PATENT DOCUMENTS

| | | | |
|---|---|---|---|
| 729,677 | 6/1903 | Schlosser | 296/82 |
| 1,470,486 | 10/1923 | Russel | 40/397 |
| 1,833,474 | 11/1931 | Robinson . | |
| 2,078,183 | 4/1937 | Ray | 40/129 |
| 2,166,048 | 7/1939 | Fritsch | 40/129 |
| 2,620,579 | 12/1952 | Dienes | 40/591 |
| 3,430,376 | 3/1969 | Drybread, Sr. et al. | 40/209 |
| 3,461,584 | 8/1969 | Wilson | 40/591 |
| 3,594,938 | 7/1971 | Mosch | 40/591 |
| 3,949,503 | 4/1976 | Waress | 40/591 |
| 4,031,942 | 6/1977 | Shelton | 160/369 |
| 4,033,619 | 7/1977 | Cox | 296/21 |

FOREIGN PATENT DOCUMENTS

| | | | |
|---|---|---|---|
| 3912 | of 1903 | United Kingdom | 296/98 |
| 48106 | 6/1981 | United Kingdom | 40/588 |

*Primary Examiner*—Laurie K. Cranmer

*Attorney, Agent, or Firm*—Donovan F. Duggan; Deborah A. Peacock

[57] ABSTRACT

The disclosure is directed to a removably attachable sign for use on a vehicle tailgate. The sign is generally rectangular and made of a flexible, durable material. The sign can contain apertures or cutaway areas for accommodating various hinges and handles commonly found on vehicle tailgates. The tailgate sign is easily secured to a tailgate by means of straps, clips, belts, snaps, hooks, bars, sheaths, or the like.

22 Claims, 4 Drawing Sheets

TAILGATE SIGN

This application is a continuation of application Ser. No. 07/409,532, filed Sep. 27, 1989 now abandoned.

1. Field of the Invention

The invention relates to removably attachable tailgate signs, and more particularly to those constructed of flexible planar material. Pick-up trucks are often used for business as well as private or recreational purposes. The instant invention provides an inexpensive tailgate sign upon which indicia may be imprinted to advertise a company name, logo, its services or products or any desired message. The sign will also protect the tailgate's finish from loose rocks on the street and highway. The tailgate sign of the invention is easily attachable by means of straps, an inflexible bar, clips, belts or the like.

The removable tailgate sign of the invention can also be used to provide a message, such as may be found imprinted on automobile bumper stickers with trendy phrases or political slogans. Greetings such as "Just Married" or "Make Your Vote Count" or "Class of 1990" or the like could be imprinted on the tailgate sign of the invention. Similarly, in election years it may be desirable to have a political candidate's name on private vehicles for the promotion of that candidate. The tailgate sign of the invention permits an economical manner of providing company identification or a personal statement and is easily removable for use on another vehicle, for cleaning, or for storage. Further, the message displayed on the sign of the invention is apparent and visible on a parked vehicle where diagonal parking is required, as well as during highway or street driving.

2. Description of the Related Art Including Information Disclosed under 37 C.F.R. 1.97-1.99

Vehicles have traditionally been dedicated either to business or family and recreational use. Because of the need to identify a business by its name or its services or products, company-owned vehicles are typically permanently marked with the company's name, logo, slogans or the like. While in some instances marking vehicles would not be desired, the vehicle owner may still wish to convey a message to passersby. The cost of placing permanent markings on vehicles can be expensive and may mar the surface of the vehicle. Adhesive backed signs can similarly cause the paint of the vehicle surface to degrade or peel away. Magnetic signs may scratch the vehicle's paint, since moisture and dirt accumulation on the vehicle surface can cause the magnets to slip along the vehicle body surface. Similarly, the irregular surfaces common to tailgates cause a magnet to seal incompletely, creating the possibility of a sign dislodging or breaking completely away from the tailgate surface.

Examples of a permanently mounted sign can be found in U.S. Pat. No. 4,033,619, to Cox, entitled TRANSPARENT TAILGATE FOR STATION-WAGONS AND PICKUP TRUCKS, which discloses a transparent panel mounted in the tailgate of a pickup truck or station wagon. The manner of attachment requires permanent mounting within the tailgate.

Removable prior art signs are disclosed in several patents. U.S. Pat. No. 1,833,474, entitled COVER FOR AUTOMOBILE DOORS, to Robinson, discloses an advertising sign for the door of an automobile made of flexible material and attached to the door by means of clips inserted in the window casings. The angle iron or clips of the '474 device would not attach easily to modern automobile window frames, which are sealed tightly, thereby precluding invasive attachment. In any event, the '474 device does not disclose a cover or fixing means to permit attachment to a truck tailgate with the inherent hinge and handle access, as in the instant invention.

U.S. Pat. No. 2,078,183, entitled SIGN, to Ray, discloses an advertising sign made of fabric which is affixed to the sides and rear of a sedan by means of a web of straps and snap fasteners. The panels of the '183 device are attached only to additional members which limit or obstruct vision through the windows and are cumbersome to attach. In addition, the attachment straps and snaps are visible and present an untidy appearance. An alternative embodiment of the '183 device shows snap fasteners permanently defacing the automobile surface.

U.S. Pat. No. 2,166,048, entitled ADVERTISING SIGN FOR VEHICLES, to Fritsch discloses an advertising sign for vehicles, which is secured on all edges requiring use of adhesive tape and strands of cord in combination with elastic bands. The '048 patent discloses a modification of a spring coil in combination with strands of cord to hold the cover in place, but does not provide for stabilization from displacement by the jarring motion of an automobile. The cord ends of the elastic or coil springs, rubber bands and tape are not generally considered to be of durable construction and would require replacement. Further, the "slidable movement" of the spring within the hem presents the likelihood of marring the automobile surface through friction caused by vehicular movement. The adhesive is required in all embodiments of the '183 device.

None of these references disclose a removably attachable, self-contained sign or banner, which is fitted to the tailgate of a pick-up truck and which does not permanently deface the tailgate to which it is attached.

SUMMARY OF THE INVENTION

In accordance with the invention, there is provided a removably attachable tailgate sign for use on a vehicle tailgate having top and bottom edges. The tailgate sign preferably comprises a generally rectangular display element comprising flexible planar material for traverse placement on the outer surface of the vehicle tailgate, the display element being large enough to overlap the top and bottom edges of the tailgate; and at least one flexible elastic or inelastic strap structure for securing the display element to the vehicle tailgate, with both edges of the display element being wrapped over the top and bottom edges of the tailgate.

The flexible planar material of the display element may comprise plastic, vinyl, polyethylene, nylon, cotton, canvas, cloth, leather, paper, fiber, metal, or the like. Straps are preferably secured to edges of the display element, preferably by heat sealing. The straps comprise fasteners such as hook and loop arrangements, hooks, interlocking loops, grommets, snaps, buttons and buttonholes, buckle and eyelets, hooks and eyes, cinch buckles, clip locking buckles, ties, and the like. The tailgate sign may further comprise side attachment means for attaching sides of the display element to sides of the tailgate, such as clamps.

The display element of the invention may comprise means for accessing a tailgate handle on the tailgate. Such access may be a cutaway area or a flap closure, but the preferred accessing means is a zipper closure.

In an alternative embodiment, the tailgate sign preferably comprises bar receiving means, including a substantially inflexible bar for securing the display element to the vehicle tailgate. The bar receiving means may comprise a hem, preferably heat sealed, to form a casing into which the bar may be inserted. The tailgate sign may further comprise means for securing the display element, such as sheath, strap means, or a securing structure along the top edge of the display element.

One object of the invention is to provide an attractive display or sign on a vehicle tailgate.

Another object of the invention is to provide a removable message while protecting the vehicle surface from scratches or marks in the paint.

Still another object of the invention is to provide a tailgate sign that can be easily detached and stored.

One advantage of the invention is that a tailgate sign in accordance therewith can be used on tailgates of varying sizes.

Another advantage of the invention is that the flexible tailgate sign snugly molds to the contours of the tailgate.

Additional objects, advantages and novel features of the invention will be set forth in part in the description which follows, and in part will become apparent to those skilled in the art upon examination of the following or may be learned by practice of the invention. The objects and advantages of the invention may be realized and attached by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. In the drawings.

DETAILED DESCRIPTION OF THE PREFERRED EMBODIMENT OF THE INVENTION

Figure 1:
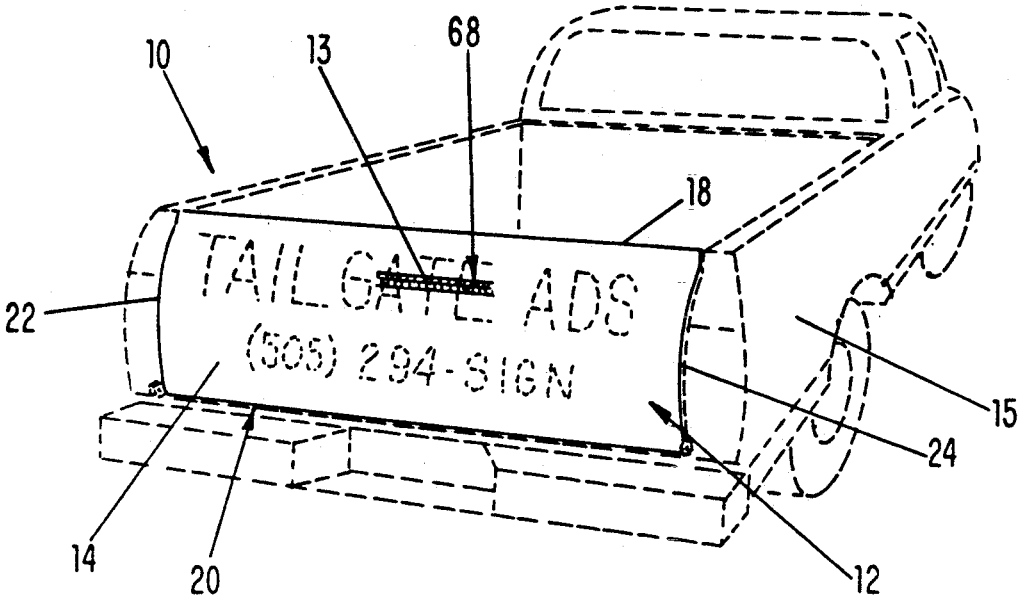
FIG. 1 illustrates a preferred embodiment of the tailgate sign of the invention attached to the tailgate of a vehicle when the tailgate is up or closed.

Reference is now made to the drawings. FIG. 1 shows a preferred embodiment of the invention wherein a tailgate sign 10 comprises a generally rectangular display element 12 secured onto the tailgate of a pick-up truck 15. To be noted is the neat appearance of flexible display element 12 contour molded against the tailgate. The display element 12 is preferably constructed of a flexible and durable material allowing for ease of washing, maintenance and convenience in storage, as well as ease of attachment onto the vehicle tailgate. Display element 12 is preferably constructed of any durable or disposable materials. As will be apparent to those skilled in the art, any flexible materials such as flexible vinyl, manufactured and sold under the marks, HERCULITE, SNYDER, UNITEX, TARAVYN or TARAVYNALL, DACRON or nylon, cloth, leather, cotton, canvas, plastic, polyethylene, metal, paper, or a durable plastic/fiber substitute such as that manufactured by DuPont under the mark TYVEK, may also be used to practice the invention. As readily shown in FIGS. 1–4 and 10, display element 12 comprises an outside face 14, an inside face 16, a top edge 18, a lower or bottom edge 20 and two side edges 22 and 24. As shown in the drawings, the securing means, such as straps, bars, or any combination thereof, may be attached to or near the display element top horizontal edge 18 and the bottom horizontal edge 20, respectively. Top edge 18 and lower edge 20 each preferably wrap over the top and lower edges of the tailgate, respectively, to provide wind resistance and a neat appearance, concealing the attachment means on the inside of the tailgate.

Figure 2:
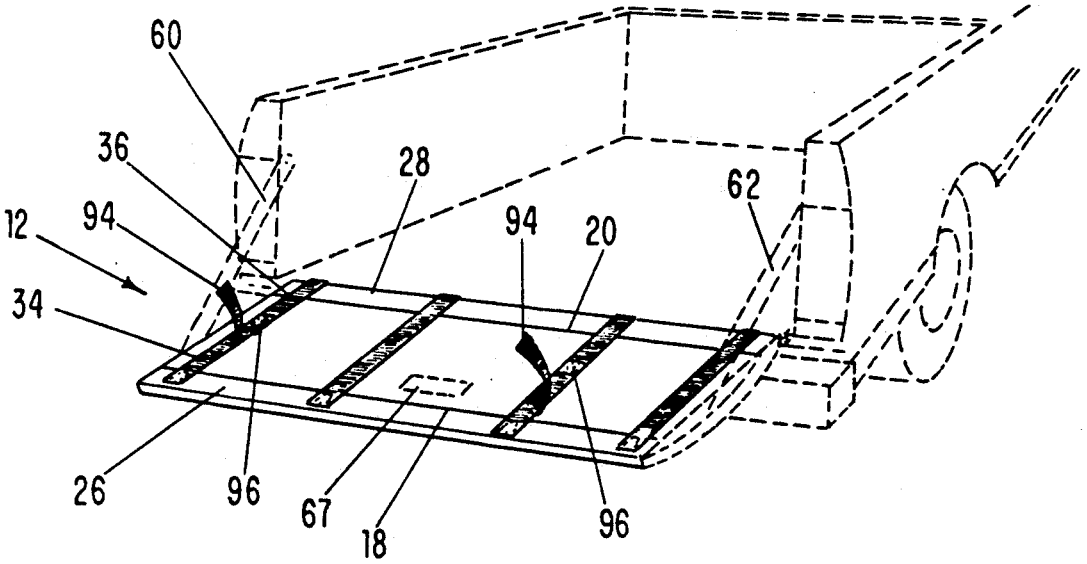
FIG. 2 shows the FIG. 1 embodiment folded over the top and bottom edges of the vehicle tailgate which is down or in its open position.
Figure 3:
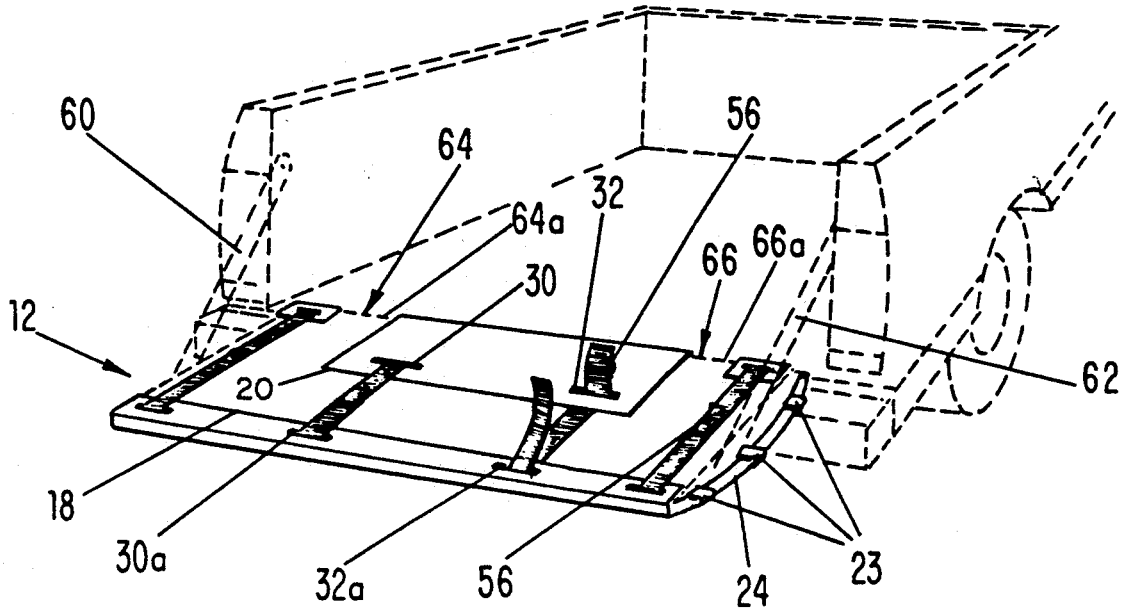
FIG. 3 shows an alternative embodiment of the sign of the invention showing elastic attachment means secured to the hem of the tailgate sign on a vehicle tailgate having hinges connected to the bed of the tailgate.
Figure 10:
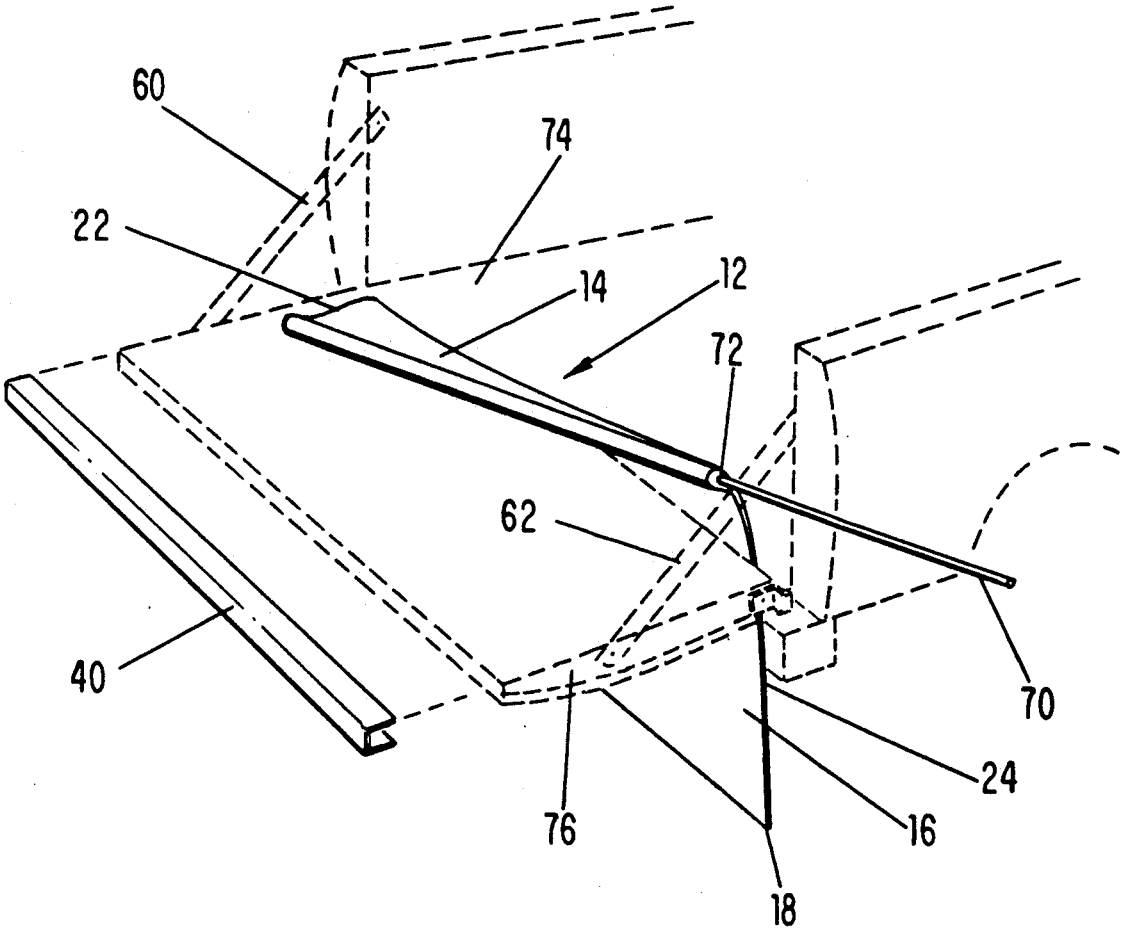
FIG. 10 illustrates an alternative embodiment of the invention with the tailgate sign held in place with an inserted bar.

Display element 12 may be constructed, such as by narrowing the display element 12 or providing cutaway portions, to accommodate or access any tailgate assembly, including side hinges 60 and 62 (see FIGS. 2, 3, and 10), bottom hinges 64 and 66 (see FIG. 3), top clip handles 63 and 65 (See FIG. 4), and interior and exterior tailgate handles 67 (see FIG. 2) and 68 (see FIG. 1), respectively. Display element 12 may further comprise accessing means, such as cut-away portions or flaps, to accommodate a tailgate hinge mechanism along the bottom edge of the tailgate. Similarly, in the preferred embodiment, display element 12 may be constructed of a generally rectangular flexible material, of sufficient width to extend substantially the width of the tailgate, so as not to interfere with the free movement of the side hinge mechanisms 60 and 62 on the tailgate (as shown in FIGS. 2, 3, and 10) or clip handle closures 63 and 65 (shown in FIG. 4) commonly found on vehicle tailgates. A bottom tailgate hinge mechanism is accommodated in an alternative tailgate sign embodiment, as shown in FIG. 3, by using a substantially rectangular flexible material of sufficient size to wrap over the top edge of the tailgate, and with cutaway portions **64*a* and 66*a*, to accommodate the bottom hinges 64 and 66 of the element 12 tailgate while allowing the bottom edge 20** to extend the tailgate sign within the inside face of the tailgate.

Figure 4:
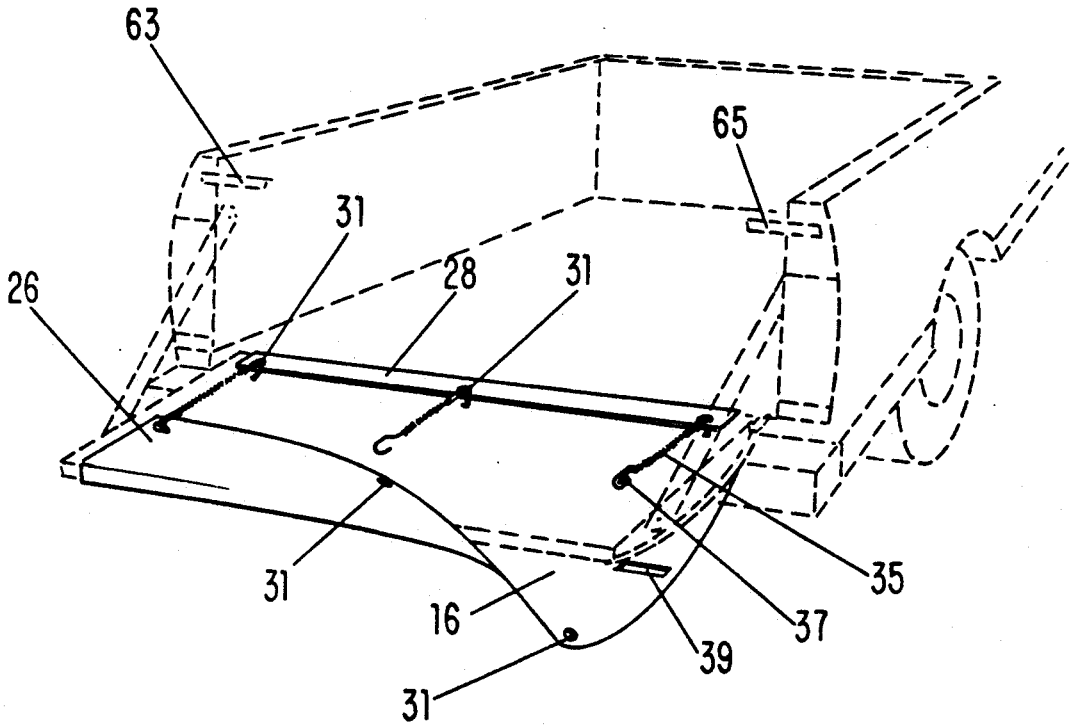
FIG. 4 is an alternative embodiment showing a view of the hem of the preferred embodiment, further comprising apertures and elastic strap placement within such apertures.

Top edge 18 may be reinforced to protect the top edge of a vehicle tailgate, as may be necessary when transporting items that extend beyond the length of a pickup bed. Similarly, a casing or sheath 40, such as shown in FIG. 10, can be disposed along the top edge 18 and over the top of the tailgate to help support the display element 12 and provide such reinforcement. Top edge 18 and lower edge 20 may further comprise strengthening folded hems 26 and 28, respectively, such as shown in FIGS. 2 and 4. The hems 26 and 28 or edges 18 and 20 can contain strap receiving apertures, such as shown in FIG. 3, as apertures 30, 30*a*, 32, and 32*a*, through which straps or other securing means may be attached. The size of such apertures will depend upon the width and thickness of the securing means. Additionally, hems 26 and 28 or edges 18 and 20 may further comprise grommets 31, such as shown in FIG. 4, for placement of attaching means, such as elastic straps 35 with hooks or clips 37 at each end. Apertures in the sign may further comprise gripping edges (not shown), such as locking teeth or other grippers (e.g., glue and other adhesives) common in the art, to assist in attaching the securing means to the display element. Hems 26 and 28 or edges 18 and 20 extend substantially the width of display element 12, stretching essentially between the tailgate sides, and are wide enough to accommodate strap attachment thereto using heat sealing, stitching, gluing, riveting, sewing, clamping, and the like.

Side edges 22 and 24 of display element 12 may similarly comprise finished edges by means of sewing or heat bonding. In addition, side edges 22 and 24 may comprise strap fastening means similar to the strap fastening means of the top 18 and 20 lower edges. Side edges may further comprise apertures for additional securing means or to accommodate handles or side locking mechanisms. FIG. 3 also illustrates side clamps 23 for securing the sides 22 and 24 (shown on side 24 only in FIG. 3) of display element 12 to the tailgate for a neat appearance to prevent flapping of the display element 12. Side clamps 23 are preferably well known and readily commercially available spreadable, frictionally engagable, plastic or metal clamps. As those skilled in the art will appreciate, they alternatively could be readily available screw down clamps, tightened with set screws or the like. Alternatively, the display element is cut narrower than the tailgate, such as shown in FIG. 4.

Typically, tailgate handles for releasing and opening the tailgate are found on the outside of a tailgate. In the preferred embodiment, shown in FIG. 1, accessing means, such as a zipper 13, is provided in display element 12 which permits access to the handle of the tailgate. Accessing means 13 may further comprise a cutaway area or tailored flap of similar material. In tailgates provided with handles 67 disposed on the inside face of the tailgate, such as shown in FIG. 2, the securing means, such as straps, are preferably positioned in such a manner as to allow free access to the handle 67, such as in pairs or other multiples on either side of the handle 67. In tailgates which utilize upper edge clip closures 63 and 65, such as shown in FIG. 4, side apertures 39 may likewise be provided. Alternatively, the tailgate sign may be of a size sufficiently wide to cover substantially the entire outside surface of the tailgate, falling short of the tailgate clip closure on both lateral ends.

FIGS. 2–9 illustrate various strap fastening means for attaching the ends of the display element on the inside of the tailgate.

Figure 5:
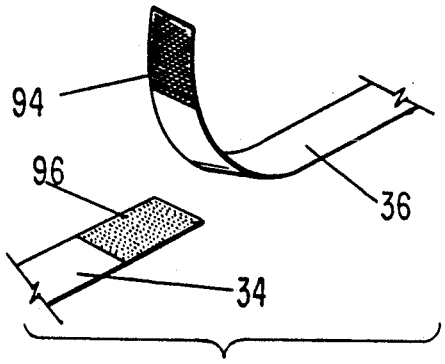
FIG. 5 depicts a hook and loop arrangement type fastener for a strap.

FIGS. 2 and 5 illustrate the preferred strap fastening means, hook or loop strip fastening arrangements 94 and 96, commonly known as VELCRO and manufactured by DuPont, on the tips only of straps 34 and 36, respectively, sufficient to permit contact between the two counter-surfaces 94 (hook) and 96 (loop) and of sufficient size to allow attachment to varying sizes of vehicle tailgates. Similarly, hook or loop straps may comprise the entire length of strap 34 and 36, respectively. Strap 34 may comprise a hook arrangement and strap 36 may comprise a loop arrangement, or vice versa, so that strap 34 may be pressed against strap 36 and each is secured against the other. Placement of such hook and loop arrangement is not intended to be limited to one strap or its complementary strap, but may occur on opposing sides of a single strap, or in any combination thereof.

Figure 6:
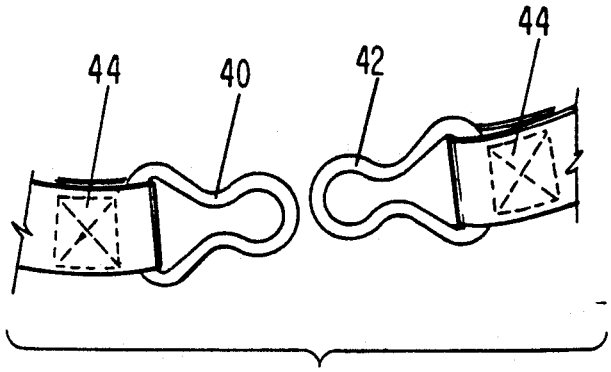
FIG. 6 depicts interlocking loop type fasteners in combination with elastic straps.
Figure 7:
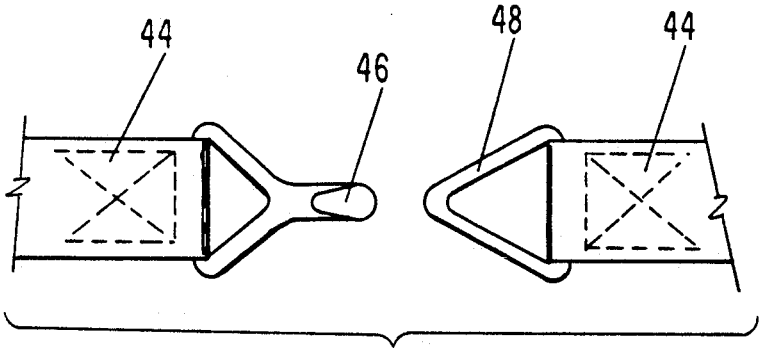
FIG. 7 shows hook and eye type fasteners on the ends of elastic straps.
Figure 8:
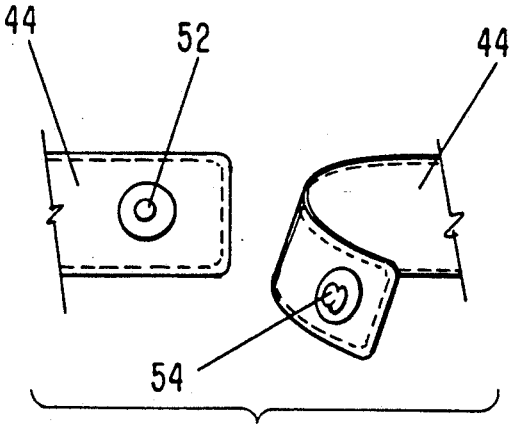
FIG. 8 shows a snap type fastener on an elastic strap.
Figure 9:
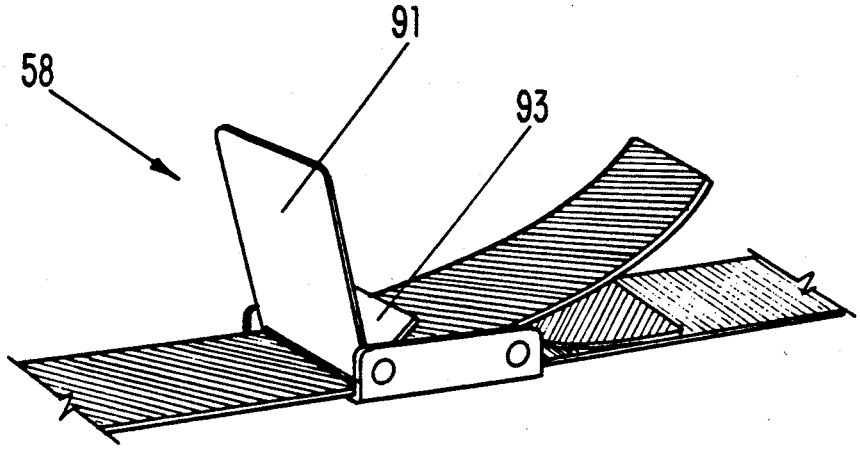
FIG. 9 shows a clip lock type fastener on an inelastic strap.

In alternative fastening embodiments, shown in FIGS. 3–4 and 6–9, straps may further comprise fastening means for interlocking the ends of the strap together, such as interlocking loop type closures, hooks, grommets, snaps, buttons, cinch buckles, clip locking buckles, ties, or hook and eye type fastening means. Bungee cords 35, shown in FIG. 4, or other such elastic straps comprising a hook 37 at each end for hooking into grommets 31 placed on the edges 18 and 20 of display element 12, as shown in FIG. 4, are useful in accordance with the invention. FIG. 6 shows an interlocking loop clasp having a first loop 40 and a second loop 42, in which loop 40 fits within loop 42, thus engaging one within the other. FIG. 7 illustrates still another fastening means utilizing a hook 46 and eye 48 which may likewise hook together. FIG. 8 illustrates yet another fastening embodiment comprising a snap arrangement having a female portion 52 and a male portion 54. Snap fasteners may be provided in multiples to allow selective placement of complementary portions thereof. FIGS. 3 and 9 show still another fastener embodiment utilizing a slip belt clip 56 and tension clip 58, respectively. The slip belt clip 56 of FIG. 3 preferably comprises a conventional three bar clip or buckle wherein straps are fastened by passing them consecutively over, under and over the bars thereof to achieve a friction hold. Tension clips 58, as seen in FIG. 9 are also conventional and comprise a lever portion 91 by which a user engages tab 93 with the strap to secure it thereby. The fasteners shown in FIGS. 6–8 are best utilized when attached to elastic straps 44. Inelastic straps are useful for the fasteners shown in FIGS. 2, 3, 5, and 9. Buttons in combination with button holes (not shown) and buckle and eyelet arrangement, such as used in clothing belts (not shown) may also be provided as fastening means, as well as clips utilizing, for example, inner faces further comprising gripping means, which, when fastened, would press the two straps together in a secure position. Other fastening means, common to the art, could also be used in connection with the instant invention. The apparatus of the invention is not limited to the specific fastening means described herein, which are furnished solely for purposes of illustration.

In an alternative embodiment, shown in FIG. 10, the display element 12 comprises a bar 70 which may be placed within hem 72 of the display element 12 of the invention. Bar 70 serves a stabilizing function of the sign 10 and rests on the inside floor of the pickup bed 74. Display element 12 is threaded between the pickup bed 74 and the tailgate 76 and draped over the top edge of the tailgate 76. The fastening means may comprise sheath 40, substantially the length of the tailgate which could be snapped over the horizontal edge of the tailgate while securing the display element 12 against the top tailgate edge. This bar embodiment may further comprise straps (not shown), rather than the sheath 40, and additional fastening means, such as discussed above.

The invention has been described in detail with particular reference to a preferred embodiment thereof, but it will be understood that variations and modifications can be effected within the scope of the invention.

What is claimed is:

1. In combination, a removably attachable truck tailgate sign and a truck tailgate, said truck tailgate having predetermined size, outer and inner surfaces, sides, and top and bottom edges, said truck tailgate sign removably attachable to and movable with said truck tailgate, said truck tailgate sign comprising:

a generally rectangular display element comprising flexible planar material for traverse placement on said outer surface of said truck tailgate and movable and integral therewith, said display element having top and bottom edges and being large enough to overlap said top and bottom edges of said truck tailgate; and means for securing said display element to said truck tailgate with said top and bottom edges of said display element overlapping said top and bottom edges of said truck tailgate, said means being secured to said overlapping edges of said display element and extending from said top and bottom edges of said display element along said inner surface from said top and bottom edges of said truck tailgate.

2. The invention of claim 1 wherein said means for securing said display element to said vehicle tailgate comprises strap means.

3. The invention of claim 2 wherein said strap means comprises at least one flexible strap.

4. The invention of claim 3 wherein said flexible strap comprises an elastic material.

5. The invention of claim 2 wherein said strap means comprises at least one fastener selected from the group consisting of hook and loop arrangements, hooks, interlocking loops, grommets, snaps, buttons and buttonholes, buckle and eyelets, and hooks and eyes.

6. The invention of claim 5 wherein said strap means comprises at least one flexible, inelastic strap.

7. The invention of claim 6 wherein said flexible, inelastic strap means comprises at least one fastener selected from the group consisting of hook and loop arrangements, cinch buckles, clip locking buckles, and ties.

8. The invention of claim 2 wherein said strap means is secured to said display element by heat sealed means.

9. The invention of claim 1 wherein said flexible planar material of said display element comprises at least one substance selected from the group consisting of plastic, vinyl, polyethylene, nylon, cotton, canvas, cloth, leather, paper, fiber, and metal.

10. The invention of claim 1 wherein said display element comprises means for accessing a tailgate handle on said tailgate.

11. The invention of claim 10 wherein said accessing means comprises zipper closure means.

12. The invention of claim 10 wherein said accessing means comprises at least one cutaway area in said display element.

13. The invention of claim 10 wherein said accessing means comprises flap closure means.

14. The invention of claim 1 wherein said tailgate sign further comprises side attachment means for attaching sides of said display element to sides of said tailgate.

15. The invention of claim 14 wherein said side attachment means comprises clamp means.

16. The invention of claim 1 wherein said means for securing said display element to said vehicle tailgate comprises a bottom edge having transverse bar receiving means on said display element.

17. The invention of claim 16 wherein said display element further comprises a top edge comprising sheath means for receiving the top edge of the tailgate.

18. The invention of claim 16 further comprising a substantially inflexible bar.

19. The invention of claim 16 wherein said bar receiving means further comprises a casing formed by a hem into which said bar is disposed.

20. The invention of claim 16 wherein said means for securing said display element to said tailgate comprises strap means.

21. The invention of claim 16 wherein said display element comprises means for accessing a tailgate handle on said tailgate.

22. The invention of claim 16 wherein said tailgate sign further comprises side attachment means for attaching sides of said display element to the sides of said tailgate.

* * * * *